US010969201B1

(12) United States Patent
Pischke

(10) Patent No.: US 10,969,201 B1
(45) Date of Patent: Apr. 6, 2021

(54) FIREARM ACCESSORY MOUNT

(71) Applicant: Sellmark Corporation, Mansfield, TX (US)

(72) Inventor: Andrew Pischke, Mansfield, TX (US)

(73) Assignee: Sellmark Corporation, Mansfield, TX (US)

( * ) Notice: Subject to any disclaimer, the term of this patent is extended or adjusted under 35 U.S.C. 154(b) by 0 days.

(21) Appl. No.: 16/789,630

(22) Filed: Feb. 13, 2020

(51) Int. Cl.
*F41G 1/34* (2006.01)
*F41G 11/00* (2006.01)

(52) U.S. Cl.
CPC ..... *F41G 11/003* (2013.01); *F41G 1/34* (2013.01)

(58) Field of Classification Search
CPC .... F41G 11/001; F41G 11/003; F41G 11/004; F41G 1/34; F41G 1/345; F41G 1/35; F41G 1/36; F41G 1/387; F41G 1/393; F21V 19/0045; F21V 19/004
See application file for complete search history.

(56) References Cited

U.S. PATENT DOCUMENTS 6,438,888 B1 8/2002 Lin et al.
6,449,893 B2 9/2002 Spinner
7,430,828 B2 10/2008 Munst
7,814,698 B2 10/2010 Fluhr et al.
7,908,782 B1 3/2011 LaRue
8,287,157 B2 10/2012 Sharrah et al.
8,490,313 B2 7/2013 Frascati et al.
8,510,983 B2 8/2013 LaRue
8,567,105 B1 * 10/2013 Bobro ..... F41G 11/003 42/127
8,845,123 B2 9/2014 Fridley
8,959,825 B2 2/2015 Goertzen
9,810,411 B2 11/2017 Galli et al.
10,466,011 B2 11/2019 Swan et al.
2010/0229450 A1 9/2010 Becker et al.
2012/0144717 A1 * 6/2012 Peterson ..... F41G 11/003 42/94
2013/0312309 A1 * 11/2013 Rorick ..... F41C 27/00 42/114

(Continued)

FOREIGN PATENT DOCUMENTS

WO WO-2016114995 A1 * 7/2016 ..... F41G 1/35

*Primary Examiner* — Stephen Johnson
(74) *Attorney, Agent, or Firm* — Mark D. Perdue

(57) ABSTRACT

A quick-attach-and-detach mount for removably securing an accessory on a rail of a firearm comprises a clamp carried by a portion of the accessory. The clamp includes a pair of generally opposing surfaces. An opposing jaw is formed on one of the generally opposing surfaces of the clamp, the fixed jaw being configured to engage an undercut on the rail. At least one movable jaw is secured in a recess in another of the generally opposing surfaces of the clamp in opposition to the fixed jaw, the movable jaw being configured to engage an undercut on an opposite side of the rail from the fixed jaw. A biasing member is disposed in the recess to urge the movable jaw into engagement with an undercut on the rail opposite that engaged by the fixed jaw, wherein the mount and accessory are attached and detached from the rail and firearm by manipulating the accessory and clamp to compress the biasing member and permit the movable jaw to move in and out of engagement with the rail.

17 Claims, 4 Drawing Sheets

(56) References Cited

U.S. PATENT DOCUMENTS

| | | | | |
|---|---|---|---|---|
| 2015/0247703 | A1* | 9/2015 | Teetzel | G01S 17/08 356/5.01 |
| 2015/0300386 | A1* | 10/2015 | Fong | F16M 11/041 24/505 |
| 2016/0281920 | A1* | 9/2016 | Perez | A61G 13/101 |
| 2018/0340754 | A1 | 11/2018 | Cosentino | |

* cited by examiner

FIREARM ACCESSORY MOUNT

BACKGROUND OF THE INVENTION

1. Field of the Invention

The present invention relates generally to mounting devices for firearm accessories. More particularly, the present invention relates to such mounting devices having quick-attach-and-detach features that increase the ease of use of accessories mounted using the device.

2. Summary of Prior Art

For decades, various sighting devices have been mounted to firearms (rifles, handguns, shotguns) using various mounting devices. More recently, various other devices, such as lights and battery or power-packs for lights and electronic sighting devices are being carried by or mounted on firearms.

The most common device to mount a sighting device or accessory on a firearm is a clamp carried by the device that clamps onto grooves in a correspondingly shaped mounting rail that is secured to the firearm. The rail may be machined into the firearm or semi-permanently attached by screws or other fasteners. The rail may be of a simple dovetail cross-section, as in the case of the common 11 mm or ⅜-inch dovetail, or of the more complex and versatile MIL-STD-1913 "Picatinny" rail or the similar Weaver rail, which combine a generally dovetail cross-section with transverse slots that engage with the mounting device to resist fore-and-aft sliding movement of the device on the rail.

Typically, the clamps employ machine screws that are tightened (or loosened) to bring together (or separate) the jaws of the clamp onto the rail to secure (or remove) the sighting device or accessory to the rail. This usually requires tools, such as allen wrenches or screwdrivers. There are also various knob- and lever-actuated "quick detach" or "QD" mounts that permit attaching and detaching the accessory or device from the firearm rail without the need for tools. They still require manipulation of the knob or lever or other arrangement to attach and detach the accessory. Because these mounting devices are usually used with sights, they must be of precise manufacture and operation in order to securely and "repeatably" mount a sighting device to a firearm without "losing zero."

As more non-sight accessories, such as lights and battery packs, are being carried on firearms, so the need for such precision mounting is reduced. Such non-sight accessories also tend to be removed and replaced more frequently than sighting devices, such as for replacement and charging of battery packs, or removing a light during daylight use.

Thus, a need exists for mounting devices that provide convenience and speed in attaching and detaching accessories, while still providing a positive and secure attachment.

SUMMARY OF THE INVENTION

It is a general object of the present invention to provide a quick-attach-and-detach mount for removably securing an accessory on a rail of a firearm. This and other objects of the present invention are achieved by providing a mount comprising a clamp carried by a portion of the accessory, the clamp including a pair of generally opposing surfaces.

An opposing jaw is formed on one of the generally opposing surfaces of the clamp, the fixed jaw being configured to engage an undercut on the rail. At least one movable jaw is secured in a recess in another of the generally opposing surfaces of the clamp in opposition to the fixed jaw, the movable jaw being configured to engage an undercut on an opposite side of the rail from the fixed jaw.

A biasing member is disposed in the recess to urge the movable jaw into engagement with an undercut on the rail opposite that engaged by the fixed jaw, wherein the mount and accessory are attached and detached from the rail and firearm by manipulating the accessory and clamp to compress the biasing member and permit the movable jaw to move in and out of engagement with the rail.

According to one embodiment of the present invention, the recess is a receptacle formed in the clamp and the movable jaw and biasing member are disposed and retained in the receptacle.

According to another embodiment of the present invention, a retaining plate is secured over the receptacle to retain the movable jaw and biasing member in the receptacle.

According to one embodiment of the present invention, the biasing member comprises a pair of coil springs disposed between a surface of the receptacle and a surface of the movable jaw.

According to another embodiment of the present invention, the movable jaw further comprises at least a pair of movable jaws.

According to one embodiment of the present invention, the movable jaw includes: an upper surface and a lower surface converging together to define a terminal end configured to engage the rail, the upper surface inclined at a first selected angle from horizontal and the lower surface inclined at a second selected angle from vertical.

According to another embodiment of the present invention, the first and second selected angles are 45 degrees.

According to one embodiment of the present invention, the opposing jaw is fixed or stationary.

According to another embodiment of the present invention, the opposing jaw may comprise one or more movable jaws.

Other objects, features, and advantages of the present invention will become apparent with reference to the drawings and the detailed description, which follow.

DETAILED DESCRIPTION OF THE INVENTION

Figure 1:
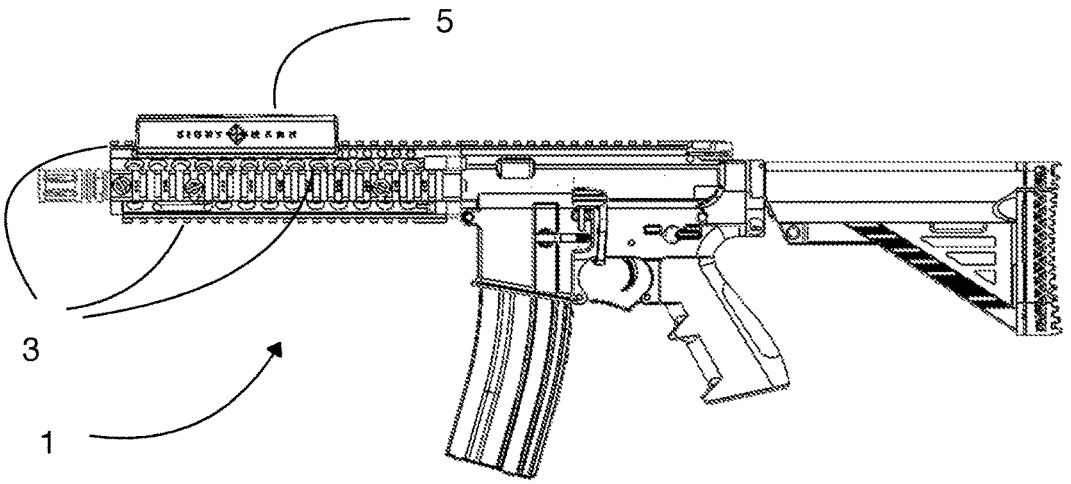
FIG. 1 is an elevation view of an exemplary firearm mounting an exemplary accessory on an exemplary rail, using the mounting device in accordance with an embodiment of the present invention.
Figure 2:
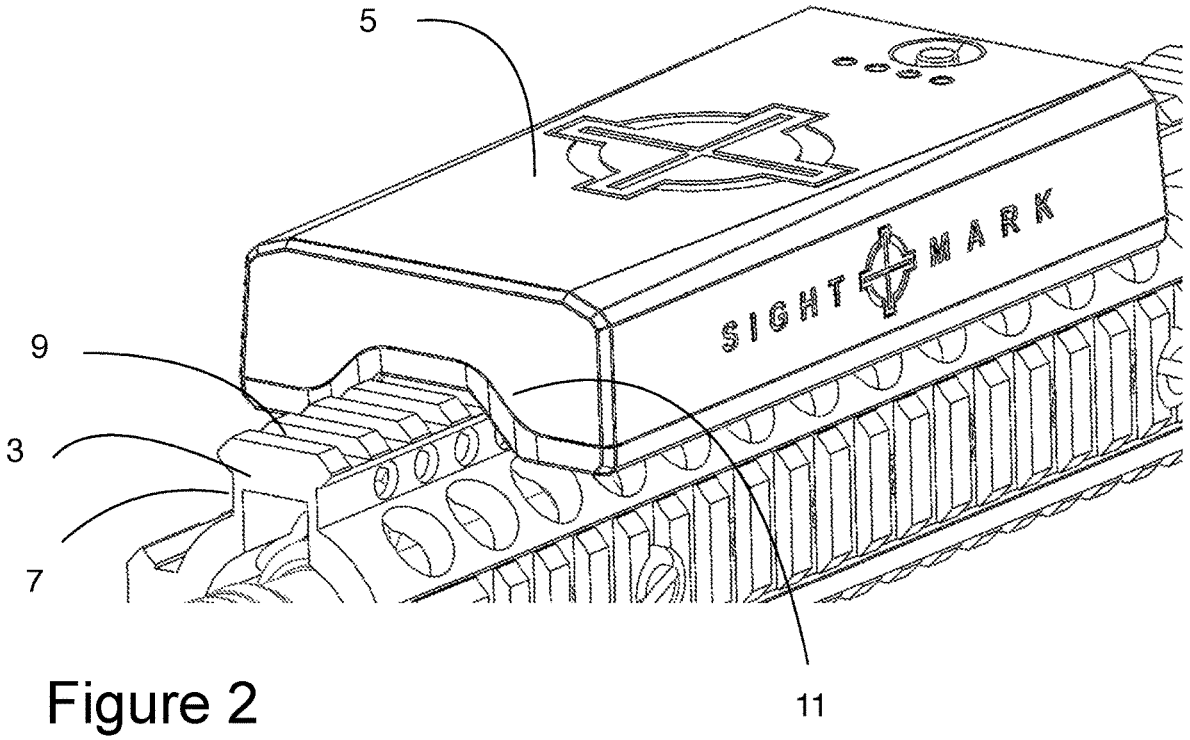
FIG. 2 is an enlarged perspective view of the accessory, mounting device, and firearm of FIG. 1.

Referring now to the Figures, and particularly to FIGS. 1 and 2, a firearm 1 of the type contemplated by the present invention is illustrated. At least one rail 3, in this case four, may be mounted about the circumference of the foreend of firearm 1. An accessory 5, in this case a battery pack, is mounted to firearm 1 by the uppermost of the four rails 3.

While a rifle is illustrated, the mounting device in accordance with the present invention has utility with handguns, shotguns and other such firearms and weapons. Similarly, while accessory 5 is shown as a battery pack, it may be any accessory desirably mounted on a firearm, to include flashlights and pointing devices, as well as sighting devices.

Rails 3 are of the "Picatinny" configuration in compliance with MIL-STD-1913. As shown In FIG. 2, each rail is of a generally dovetail cross-section, with a first and second longitudinally opposed grooves or undercuts 7 on each side. A plurality of laterally or transversely extending slots 9 may be formed in the upper surface of each rail 3.

A clamp or mounting device 11 in accordance with the present invention secures accessory 5 to rail 3. While a Picatinny rail is depicted, the mounting device in accordance with the present invention has utility with the similar Weaver rail and may be adapted to other rail configurations with grooves or undercuts, such as the 11 mm or ⅜" dovetail.

Figure 3:
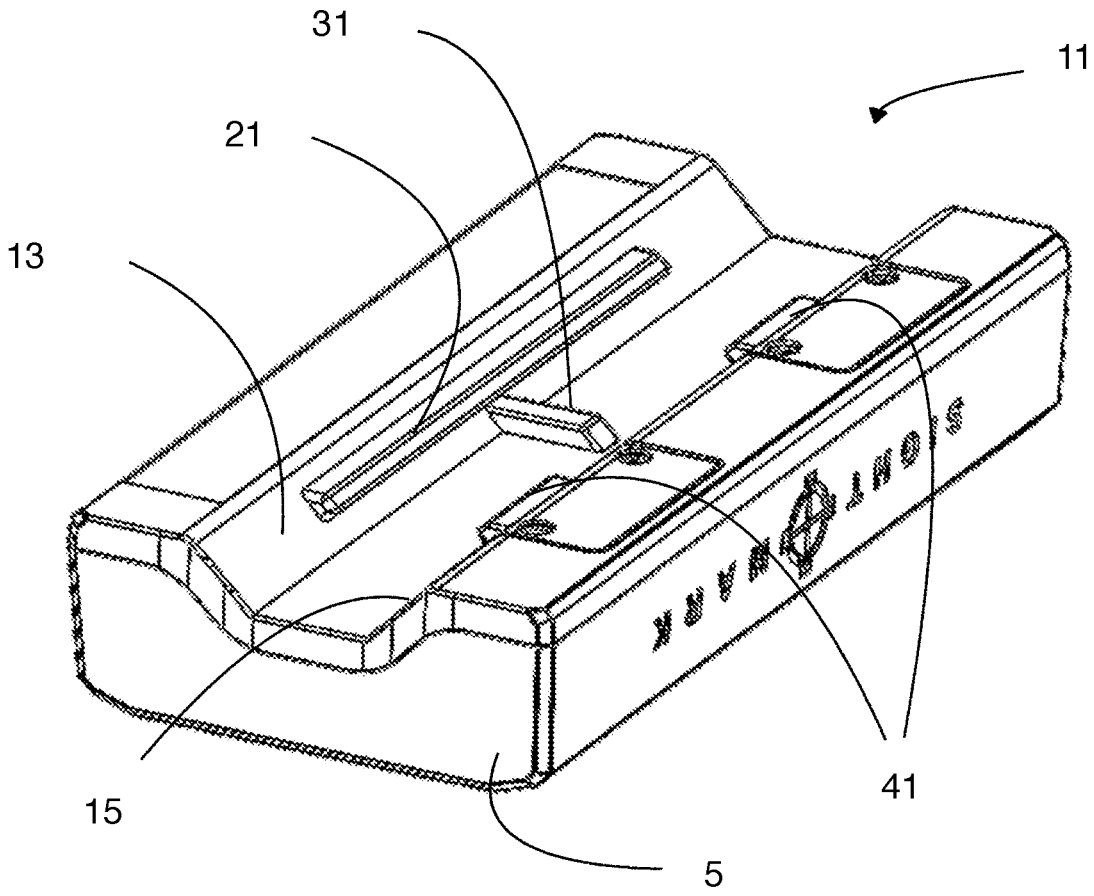
FIG. 3 is a bottom perspective view of the accessory of FIGS. 1 and 2.

FIGS. 3 though 5 depict mounting device 11 in accordance with a preferred embodiment of the present invention in greater detail. As shown, with accessory 5 oriented as illustrated, mounting device 11 is formed or mounted or secured to its underside. While mounting device 11 is formed "integrally" with (part of or not easily removed) battery pack accessory 5, it may also be secured to or carried by accessory 5 by fasteners, such as screws, and the like so that device 11 can be removed and re-attached to accessory 5

Device 11 may be considered a "clamp" and has a first and second generally parallel and opposed surfaces 13, 15. In a preferred embodiment, surfaces 13, 15 may be angled as shown, diverging toward the bottom or opening of the mount, to facilitate alignment of accessory 5 and mount 11 over rail 3.

A stationary or fixed jaw 21 may be formed or carried on one of opposing surfaces 13, while one or more movable jaws 41 may be mounted on the other surface 15, generally opposite from or in opposition to fixed jaw 21. A key 31 extends transversely or laterally between opposing surfaces 13, 15. Fixed 21 and movable 41 jaws 41 engage the undercut 7 on rail 3 to removably secure accessory 5 to firearm 1. Key 31 engages one of slots 9 on rail 3 to fix and secure accessory 5 against longitudinal movement or sliding along rail 3. At least one movable jaw 41 is required for the function of mount 11. More movable jaws 41 may be desirable with longer or heavier accessories 5.

Additionally, fixed jaw 21 may be replaced with one or more movable jaws as described herein. A fixed or stationary jaw is a simpler and less expensive alternative, but having movable jaws on each opposing side 11, 13 of clamp may provide additional ease of attachment and detachment. Thus, whether fixed or movable, jaw 21 acts in opposition to movable jaws 41 and may be considered an "opposing jaw."

Figure 4:
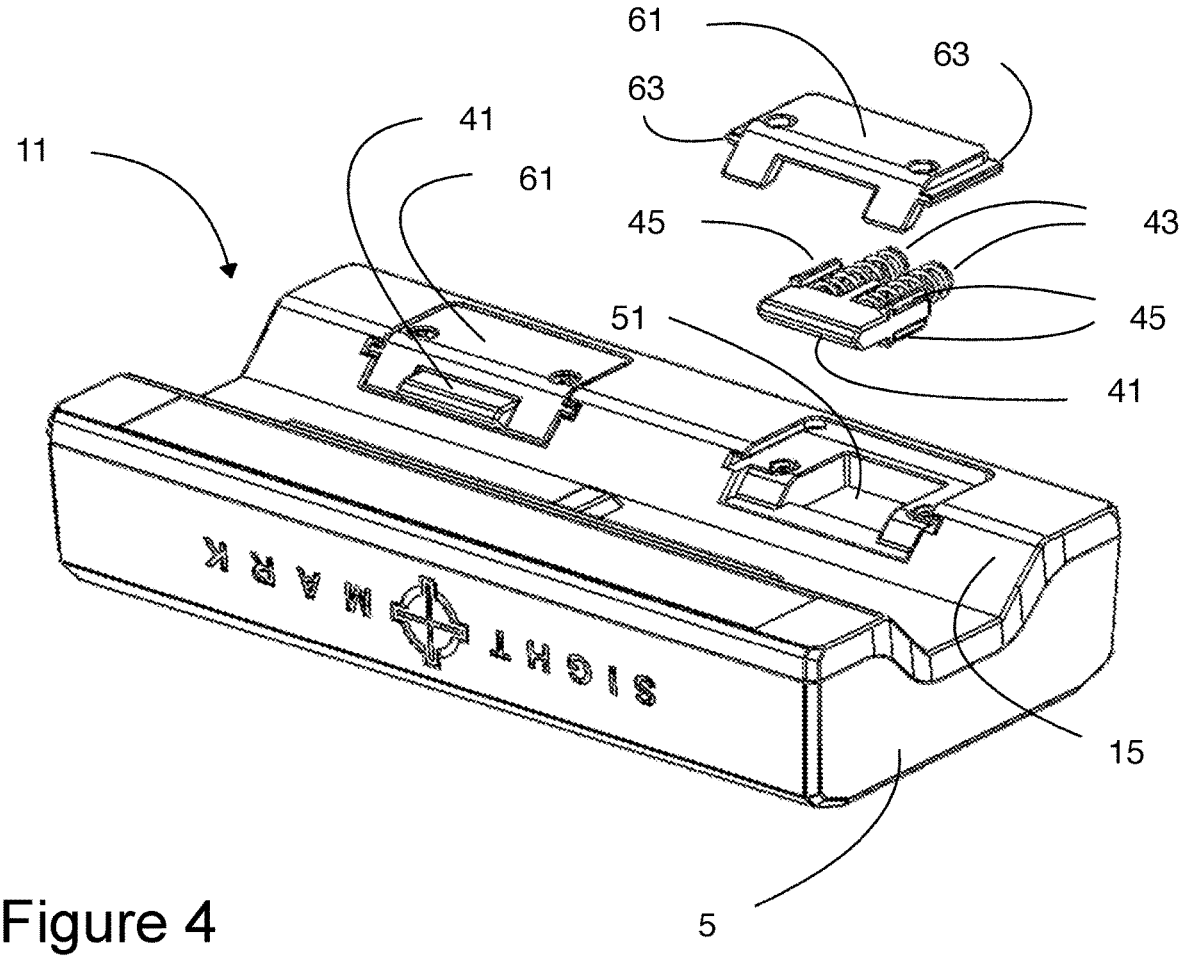
FIG. 4 is a bottom perspective view of the accessory of FIGS. 1, 2, and 3, with a movable jaw portion of the mounting device shown in exploded view.
Figure 5:
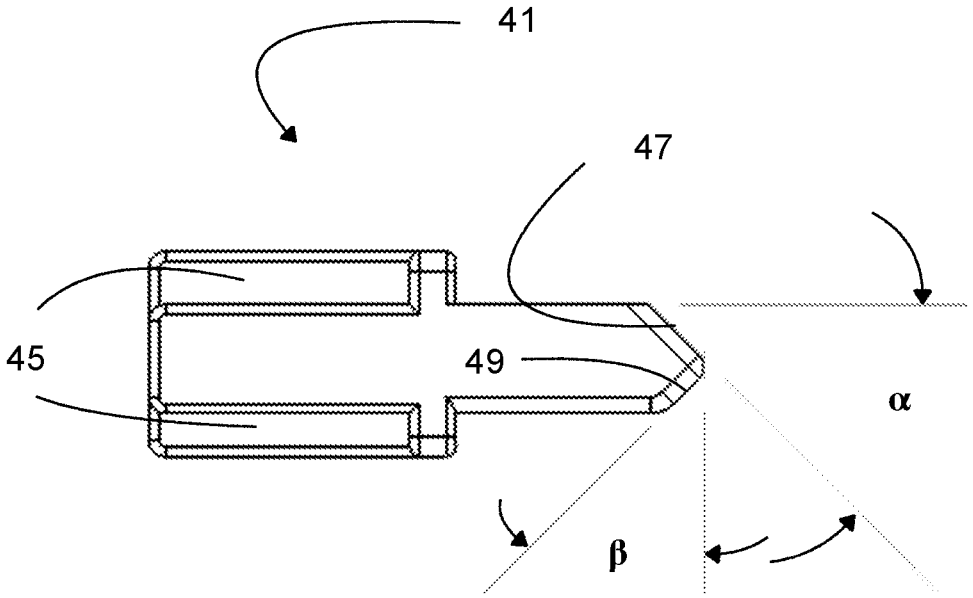
FIG. 5 is a side elevation view of the movable jaw illustrated in FIGS. 3 and 4.

As shown in FIGS. 4 and 5, each movable jaw 41 is received in a recess or receptacle 51. Recess or receptacle 51 preferably may be rectangular or rectilinear in configuration and includes at least one longitudinal surface that extends generally perpendicular to surface 15 (note that due to the inclination of clamp surface 15, recess or receptacle 51 is not precisely perpendicular, but sufficiently so that movable jaw 41 moves generally perpendicularly to rail 3 when device 11 is positioned on rail 3). The surfaces of recess or receptacle 51 confine and constrain movable jaw 41 to move or reciprocate in a linear fashion along a straight path into and out of engagement with undercut 7. A biasing member in the form of pair of coil springs 43 may be confined in recess or receptacle 51. Springs 43 act between jaw 41 and a rear wall of the receptacle 51 to bias jaw 41 outwardly from receptacle 51 or toward opposing jaw 21.

Four vertical ribs 45 may be provided on the corners of jaw 41. Movable jaw 41 may include a terminal end comprising a pair of upper and lower converging surfaces 47, 49, which each are angled $\alpha,\beta$ at 45 degrees from horizontal and vertical, respectively. The apex or convergence point of surfaces 47, 49 is below the centerline of jaw 41, making upper surface 47 longer than lower surface 49. Upper surface 47 mates with a corresponding 45 degree surface at the top of undercut or groove 7 in rail 3. Further, the angled surfaces 47, 49 of jaw 41 assist in moving it inward and outward from receptacle 51 as jaw 41 engages the surfaces of rail 3. The 45 degree angles $\alpha,\beta$ and end configuration are well-suited to the Picatinny and similar Weaver rails. Other angles and configurations may better suited for mounts adapted to engage other types of rails.

A retainer plate 61 retains or confines jaw 41 and springs 43 in receptacle 51. Ribs 45 cooperate with retainer plate 61 and receptacle 51 to retain jaw 41 while permitting it to slide or move in and out of receptacle 51. A pair of horizontal ribs 63 extend from plate 61 into corresponding recesses in mount or clamp 11 to assist in retaining plate 61.

The components of mount 11 may be formed of polymeric or metallic materials. Polymeric materials include ABS, PPS, and glass-filled nylon, while the metallic materials include steel, aluminum, and titanium. According to a preferred embodiment of the invention, the clamp portion of device 11 and movable jaw are formed of polymeric material, while springs 43 and retainer plate 61 are formed of metallic material.

In operation, accessory 5 may be attached to rail 3 of firearm 1 by aligning accessory 5 and mount 11 over rail 3, including registering key 31 with one of slots 9. It may be helpful during attachment to engage opposing or fixed jaw 21 with groove 7 in rail 3 and rotate accessory 3 about rail 3 using fixed jaw 21 as a pivot. By applying force to accessory 5 generally perpendicular to rail 3, movable jaws 41 engage the upper surface of rail 3 and the biasing force of springs 43 is overcome, permitting jaws 41 to move inwardly, into receptacle 51 and away from fixed jaw 21. Upon full engagement of rail 3 within mount 11, opposing jaw 21 engages groove 7 on one side of rail 3, while movable jaws 41 extend outwardly from receptacle 51 to engage groove 7 on the opposite or opposing side of rail 3. Accessory 5 is then retained on rail 3 and firearm 1 by the engagement or clamping force exerted between opposing fixed 21 and movable jaws 41 on the undercuts or grooves 7 in rail 3.

To remove or detach accessory 5 from rail 3 and firearm 1, the attachment process may be reversed. Again, tt may be helpful during removal to tilt or rotate accessory 3 using fixed jaw 21 as a pivot. The application of sufficient force to accessory 5 and mount 11 overcomes the force of springs 43, permitting movable jaws 41 to move into or inwardly within receptacle 51, away from fixed jaw 21, and out of engagement with undercut or groove 7 in rail 3. Although some users may prefer the described mode of removing and attaching accessory 5, one advantage is that no particular mode is required: the device is adaptable to the user. Thus, accessory 5 may be mounted and dismounted from firearm 1 without tools and without manipulation of levers or knobs or other fixtures. The convenience and utility of accessory 5 is thereby increased.

The invention has been described with reference to preferred embodiments thereof. It is thus not limited, but is susceptible to variation and modification without departing from the scope and spirit thereof.

I claim:

1. A mount for removably securing an accessory on a rail of a firearm, the rail including a first and a second opposing undercuts, the mount comprising:

a clamp carried by a portion of the accessory, the clamp including a first and second generally opposing surfaces;

an opposing jaw formed on the first of the generally opposing surfaces of the clamp, the jaw configured to engage the first undercut on the rail;

a generally rectangular recess formed in the second of the generally opposing surfaces of the clamp in opposition to the opposing jaw, the recess including a plurality of surfaces and at least one of the surfaces extending generally perpendicularly to the opposing surface;

at least one movable jaw disposed in the recess and constrained by the surfaces of the recess to move generally linearly and along a generally straight path into and out of engagement with the rail;

a biasing member in the recess;

a retaining plate secured over the recess to retain the movable jaw and the biasing member in the recess wherein the biasing member acts between one of the surfaces of the recess and a surface of the movable jaw to urge the movable jaw into engagement with the second undercut on the rail opposite that engaged by the opposing jaw, wherein the mount and the accessory are attached and detached from the rail and the firearm by manipulating the accessory and the clamp to compress the biasing member and permit the movable jaw to move in and out of engagement with the second undercut on the rail.

2. The mount according to claim 1, wherein the biasing member comprises a pair of coil springs disposed between the surface of the receptacle and the surface of the movable jaw.

3. The mount according to claim 1 further comprising a second movable jaw spaced apart from the movable jaw along the second clamp surface to engage the second undercut on the rail at different locations.

4. The mount according to claim 1, wherein the movable jaw includes:

an upper surface and a lower surface converging together to define a terminal end configured to engage the rail, the upper surface inclined at a first selected angle from horizontal and the lower surface inclined at a second selected angle from vertical.

5. The mount according to claim 4, wherein the first and second selected angles are 45 degrees.

6. The mount according to claim 1, wherein the opposing jaw further comprises a stationary jaw.

7. A mount for removably securing an accessory on a rail of a firearm, the rail including a first and a second opposing undercuts, the mount comprising:

a clamp carried by a portion of the accessory, the clamp including a first and second generally opposing surfaces;

a fixed jaw formed on the first of the generally opposing surfaces of the clamp, the fixed jaw configured to engage the first undercut on one side of the rail;

at least a pair of recesses formed in the second of the generally opposing surfaces of the clamp, the recesses being spaced apart and each including at least one surface extending generally perpendicular to the second surface of the clamp;

a movable jaw disposed in each of the recesses in opposition to the fixed jaw, the movable jaw reciprocating linearly and along a generally straight path within the recess configured to engage the second undercut on an opposite side of the rail from the fixed jaw;

a spring in each of the recesses, the spring arranged to urge the movable jaw into engagement with the undercut on the rail in opposition to the fixed jaw, wherein the mount and the accessory are attached and detached from the rail and the firearm by manipulating the accessory and the clamp to compress the spring and permit the movable jaw to move in and out of engagement with the second undercut on the rail.

8. The mount according to claim 7, further comprising:

a retaining plate secured over each of the recesses to retain the movable jaw and spring in each of the recesses.

9. The mount according to claim 7, wherein the spring comprises a pair of coil springs disposed between a surface of the recess and a surface of the movable jaw.

10. The mount according to claim 7, wherein the movable jaw includes: an upper surface and a lower surface converging together to define a terminal end configured to engage the rail, the upper surface inclined at a first selected angle from horizontal and the lower surface inclined at a second selected angle from vertical.

11. The mount according to claim 10, wherein the first and second selected angles are 45 degrees.

12. A mount for removably securing an accessory on a rail of a firearm, the rail including first and second opposing undercuts, the mount comprising:

a clamp carried by a portion of the accessory, the clamp including a first and second generally opposing surfaces configured to receive the rail;

an opposing jaw formed on the first of the generally opposing surfaces of the clamp, the jaw configured to engage the first undercut on the rail;

a generally rectangular recess formed in the second of the generally opposing surfaces of the clamp in opposition to the opposing jaw, the recess including at least one surface extending generally perpendicularly to the second generally opposing surface;

at least one generally rectangular movable jaw having a forward edge and a rear edge, the movable jaw disposed in the recess and constrained by the surface of the recess to reciprocate the forward edge generally linearly and along a generally straight path into and out of engagement with the second undercut on an opposite side of the rail from the opposing jaw;

a biasing member in the recess, the biasing member acting between the rear edge of the movable jaw and a surface of the recess to urge the movable jaw into engagement with the second undercut on the rail, wherein the mount and the accessory are attached and detached from the rail and the firearm by manipulating the accessory and the clamp to compress the biasing member and permit the movable jaw to move in and out of engagement with the second undercut on the rail;

a retaining plate secured over the receptacle to retain the movable jaw and the biasing member in the recess.

13. The mount according to claim 12, wherein the biasing member comprises a pair of coil springs disposed between the rear surface of the recess and the rear edge of the movable jaw.

14. The mount according to claim 12, further comprising at least a pair of movable jaws spaced apart from one another to engage the rail at different locations.

15. The mount according to claim 12, wherein the forward edge of the movable jaw further comprises:

an upper surface and a lower surface converging together to define a terminal end configured to engage the rail, the upper surface inclined at a first selected angle from horizontal and the lower surface inclined at a second selected angle from vertical.

16. The mount according to claim 15, wherein the first and second selected angles are 45 degrees.

17. The mount according to claim 12, wherein the opposing jaw further comprises a stationary jaw.

* * * * *